United States Patent [19]

Yamada

[11] Patent Number: 4,932,455

[45] Date of Patent: Jun. 12, 1990

[54] FOLDING DOOR APPARATUS

[75] Inventor: Nobuyuki Yamada, Yamanashi, Japan

[73] Assignee: Kabushiki Kaisha Murakoshi Seiko, Tokyo, Japan

[21] Appl. No.: 411,721

[22] Filed: Sep. 25, 1989

[30] Foreign Application Priority Data

Apr. 3, 1989 [JP] Japan ..... 1-84608

[51] Int. Cl.[5] ..... E05D 15/26

[52] U.S. Cl. ..... 160/199; 160/118; 292/300

[58] Field of Search ..... 160/199, 117, 118, 119, 160/206, 207, 213; 292/300, 19; 16/1 R, 1 C

[56] References Cited

U.S. PATENT DOCUMENTS

| | | | |
|---|---|---|---|
| Re. 27,066 | 2/1971 | Williams | 160/199 X |
| 1,051,054 | 1/1913 | Anderson | 160/206 |
| 2,839,776 | 6/1958 | Nelson | 160/206 |
| 2,953,809 | 9/1960 | Nelson | 16/1 |
| 3,277,951 | 10/1966 | Levicke | 160/206 X |
| 3,329,990 | 7/1967 | Johnson | 160/199 X |
| 3,351,973 | 11/1967 | Lawrence | 160/199 X |
| 3,361,188 | 1/1968 | Rudnick | 160/206 |
| 3,871,083 | 3/1975 | Smith | 160/118 X |
| 4,726,637 | 2/1988 | Ishizawa et al. | 160/199 X |
| 4,729,615 | 3/1988 | Ishizawa et al. | 160/199 X |

FOREIGN PATENT DOCUMENTS 254776 of 1986 Japan .

*Primary Examiner*—David M. Purol
*Attorney, Agent, or Firm*—Nilles & Nilles

[57] ABSTRACT

A folding door apparatus having a folding door made up of a pair of door bodies with the internal ends of the paired door bodies rotatably connected together so that the door bodies can be folded at the internal ends; guide hinge bodies fitted to the upper and lower portions of each of the door bodies of the folding door; and guide rails for supporting and guiding, through the guide hinge bodies, the door bodies of the folding door as they are folded together for opening the door or stretched flat for closing the door. The guide hinge bodies each have a base, a hinge mechanism and a support member. The support member is mounted rotatably on the base through the hinge mechanism. The base is secured to the outer end of each door body. The support member is provided with a guide member supported movably by the guide rail and is formed with a connector portion which removably connects together the support members on the paired door bodies that come close to each other when the door bodies are folded to the extreme open condition.

2 Claims, 6 Drawing Sheets

FOLDING DOOR APPARATUS

BACKGROUND OF THE INVENTION

1. Field of the Invention

This invention relates to a folding door apparatus which is made foldable by rotatably connecting the inner facing ends of a pair of door bodies.

The folding door apparatus of this kind is used as a door for opening and closing the front of the storage space in furniture such as a wardrobe and closet.

Conventional folding door apparatuses used on these furniture are known to have a construction as disclosed in the Japanese Patent Laid-Open No. 254,776/1986.

The conventional folding door apparatus is constructed as shown in FIG. 10. The facing inner ends of paired door bodies b of the folding door a are rotatably connected together. On the upper and lower ends of each door body b are mounted guide hinge bodies d having roller mechanisms movable along guide rails c that are laid on the upper and lower edges of the front opening portion of the furniture, and hinge mechanisms that allow the door bodies b to rotatably support with respect to the roller mechanisms.

One or both of the paired door bodies b of the folding door a that closes the front of the furniture is or are pulled forward and moved toward each other. This causes the roller mechanisms of the upper and lower guide hinge bodies d on one or both of the paired door bodies b to move along the guide rails c, folding the door through the hinge mechanisms of the guide hinge bodies d until the backs of the door bodies b come close together. Thus, the front part of the furniture is opened.

In the above folding door apparatus, the folding door a can be moved along the guide rails c to the left or right side of the furniture with the folding door a opened, i.e., the paired door bodies b folded.

However, when the folding door a in its open condition, i.e., with the paired door bodies b folded, is moved along the guide rails c by pushing the folded end portion of the folding door a, as shown in FIG. 10, the force F applied to the folded end portion produces a compressive force C in the left door body b and a tensile force T in the right door body b. As a result, the guide hinge body d on each door body b becomes inclined relative to the guide rail c as indicated by two-dot lines in the figure, badly deteriorating the running performance of the guide hinge body d along the guide rail c.

Depending on the force F applied, the folding door a intermittently stops and moves along the guide rail in a swinging motion, making the movement of the folded door unsmooth.

SUMMARY OF THE INVENTION

This invention has been accomplished with a view to overcoming the above drawbacks and its object is to provide a folding door apparatus which permits smooth movement along the guide rails of the folding door in the open condition, i.e., with the paired door bodies folded together.

The folding door apparatus according to this invention comprises a folding door made up of a pair of door bodies with the internal ends of the paired door bodies rotatably connected together so that the door bodies can be folded at the internal ends; guide hinge bodies fitted to the upper and lower portions of each of the door bodies of the folding door; and guide rails for supporting and guiding, through the guide hinge bodies, the door bodies of the folding door as they are folded together for opening the door or stretched flat for closing the door. The guide hinge bodies each have a base, a hinge mechanism and a support member. The support member is mounted rotatably on the base through the hinge mechanism. The base is secured to the outer end of each door body. The support member is provided with a guide member supported movably by the guide rail and is formed with a connector portion which removably connects together the support members on the paired door bodies that come close to each other when the door bodies are folded to the extreme open condition.

In this invention since the outer sides of the paired door bodies are connected together by the connector portions of the guide hinge bodies fitted to the outer sides of the door bodies when the paired door bodies of the folding door are folded to the extreme open condition, the guide hinge bodies can be prevented from inclining with respect to the guide rails when the folded door is moved along the guide rails by pushing sideways the front portion thereof, thereby assuring smooth movement along the guide rails of the folded door.

These and other objects and features of this invention will become apparent from the following description when taken in conjunction with the attached drawings.

DESCRIPTION OF THE PREFERRED EMBODIMENTS

Now, one embodiment of this invention will be described by referring to FIGS. 1 through 6.

Figure 1:
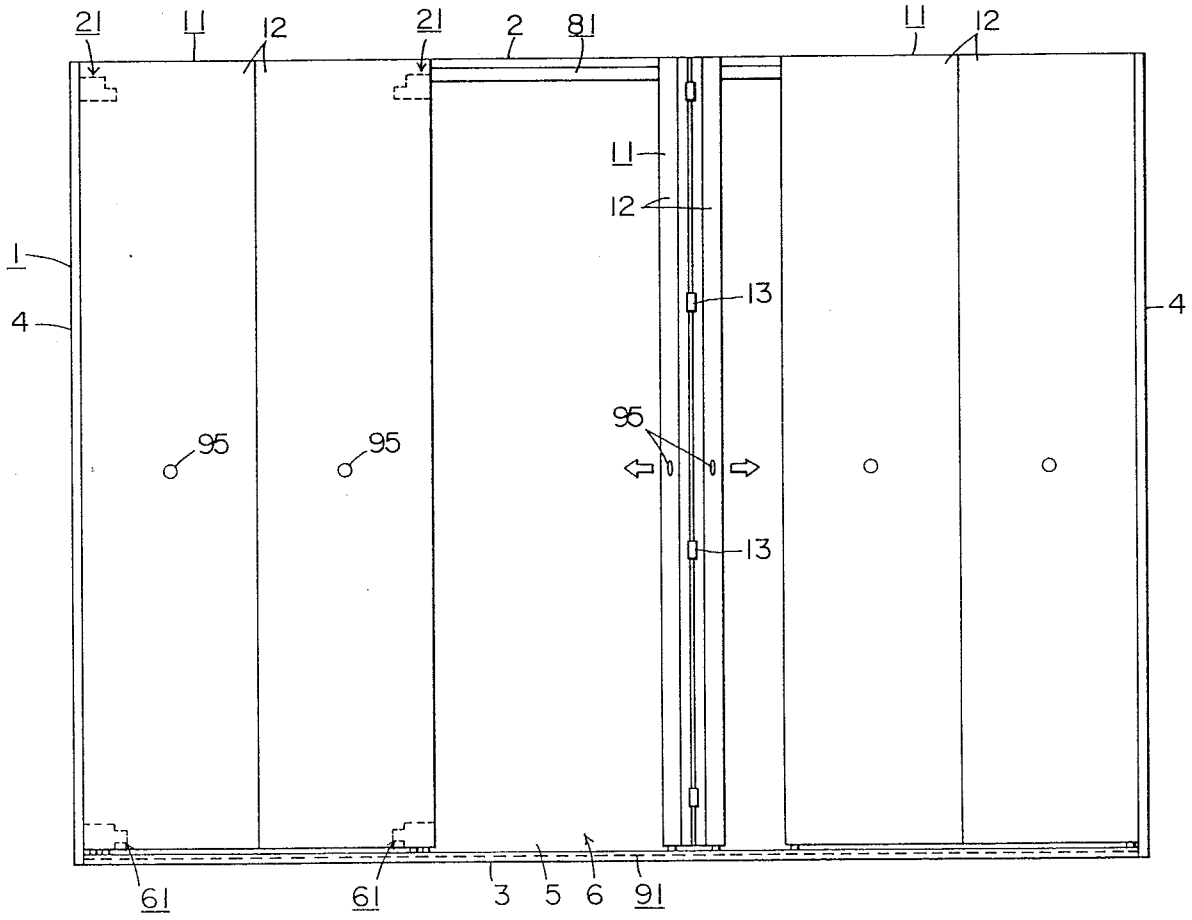
FIG. 1 is a front elevational view of the folding door apparatus as one embodiment of the invention.
Figure 3:
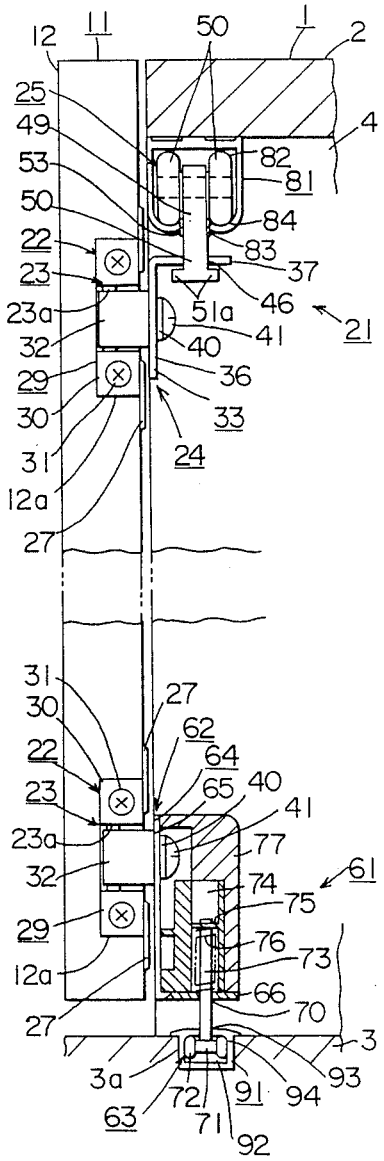
FIG. 3 is a partial cross-sectional view of the first embodiment as seen from one side.
Figure 2:
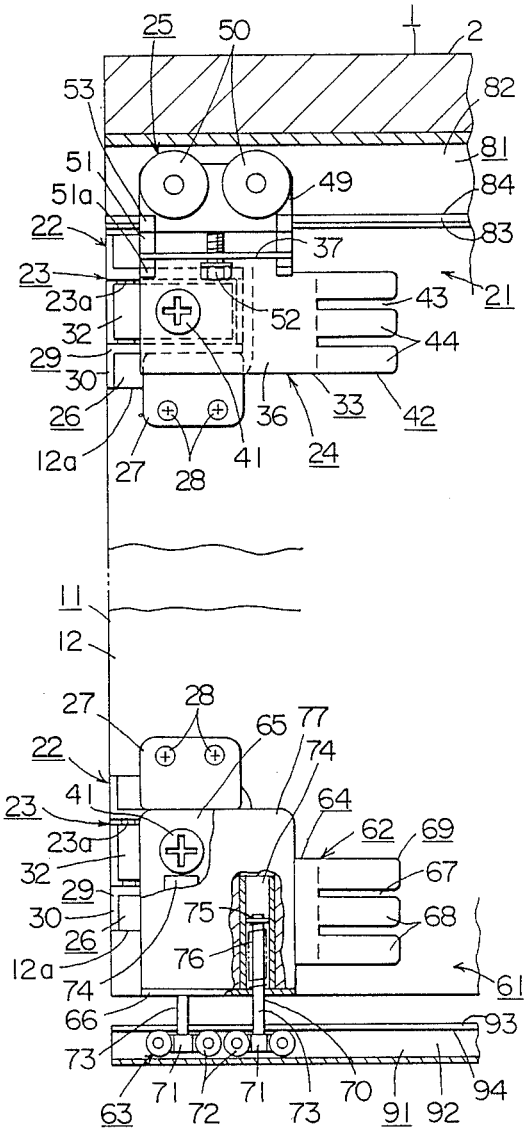
FIG. 2 is a partial cross-sectional view of the first embodiment as seen from the back.

In FIGS. 1 to 3, reference numeral 1 represents furniture which consists of a ceiling plate 2, a bottom plate 3, side plates 4 on both sides, and a back plate 5, these forming a storage space 6 that opens at the front.

Denoted 11 is a folding door and three such folding doors 11 are used to close the front of the storage space 6 of the furniture 1. Each of the folding doors 11 has a pair of vertically elongate door bodies 12, which are rotatably connected together at their facing inner ends by a plurality of hinges 13 so that the door bodies 12 can be folded drawing their rear surfaces close together. The hinges 13 are of a construction that resiliently retains the unfolded door bodies 12 in a flat-aligned state.

An upper guide hinge body 21 is attached to the upper end of and on the outer side of each door body 12 of the folding door 11. The guide hinge body 21 has a base 22 secured to the door body 12, a support member 24 supported rotatably on the base 22 through a hinge mechanism 23, and a guide member 25 supported movably by a guide rail 81 described later.

The base 22 has a base cup 26, U-shaped in a vertical cross section, embedded in a groove 12*a* formed in the rear surface of the door body 12. Mounting pieces 27 are projected from the upper and lower edges of the base cup 26 to engage the rear surface of the door body 12. A plurality of set screws 28 are screwed through the mounting pieces 27 into the door body 12 to securely fix the base cup 26 to the door body 12.

Fitted inside the base cup 26 is a hinge cup 29, U-shaped in vertical cross section, which can be inserted into and removed from the base cup 26 from the outer side. When inserted in the base cup 26, the hinge cup 29 is held in a predetermined position inside the base cup 26. The hinge cup 29 has mounting pieces 30 projecting from the outer ends of the upper and lower portions thereof. The mounting pieces 30 engage the outer ends of the upper and lower portions of the base cup 26. The hinge cup 29 is securely fixed to the outer ends of the upper and lower portions of the base cup 26 by the mounting pieces 30 and set screws 31. A hinge shaft 23*a* of the hinge mechanism 23 is press-fitted into the upper and lower portions of the hinge cup 29 near the outer ends.

The support member 24 is made up of a support arm 32 rotatably supported on the base 22 through the hinge shaft 23*a*, and a support plate 33 mounted on the support arm 32. The support arm 32 is rotatably supported at the outer end on the hinge shaft 23*a* so that it can oscillate about the hinge shaft 23*a* to advance into and retract from the inside of the hinge cup 29. On its back, the support arm 32 has a raised boss 34 with a screw hole (not shown) and a rib 35 formed outside the boss 34.

Figure 6:
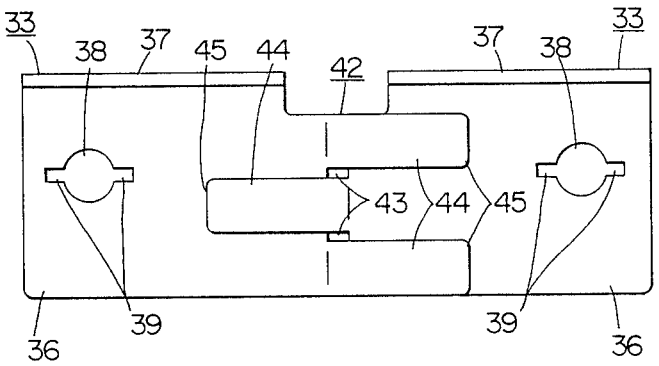
FIG. 6 is a front view of a support plate.

The support plate 33 of the support member 24 is formed like a letter L and consists of a vertical plate portion 36 and a horizontal plate portion 37. As shown in FIG. 6, the vertical plate portion 36 is formed with engagement holes 38 in which the boss 34 of the support arm 32 engages, and also formed with grooves 39 in which the rib 35 engages. With the boss 34 of the support arm 32 engaged in the engagement hole 38 and projecting from the back of the vertical plate portion 36, a ring spacer 40 is fitted over the boss 34 and a set screw 41 is screwed into the threaded hole of the boss 34, as shown in FIG. 3. As a result, the head portion of the set screw 41 engages the spacer 40, fastening the support arm 32 and the support plate 33 together. The engagement of the rib 35 with the groove 39 prevents the relative rotation between the support arm 32 and the support plate 33.

Figure 4:
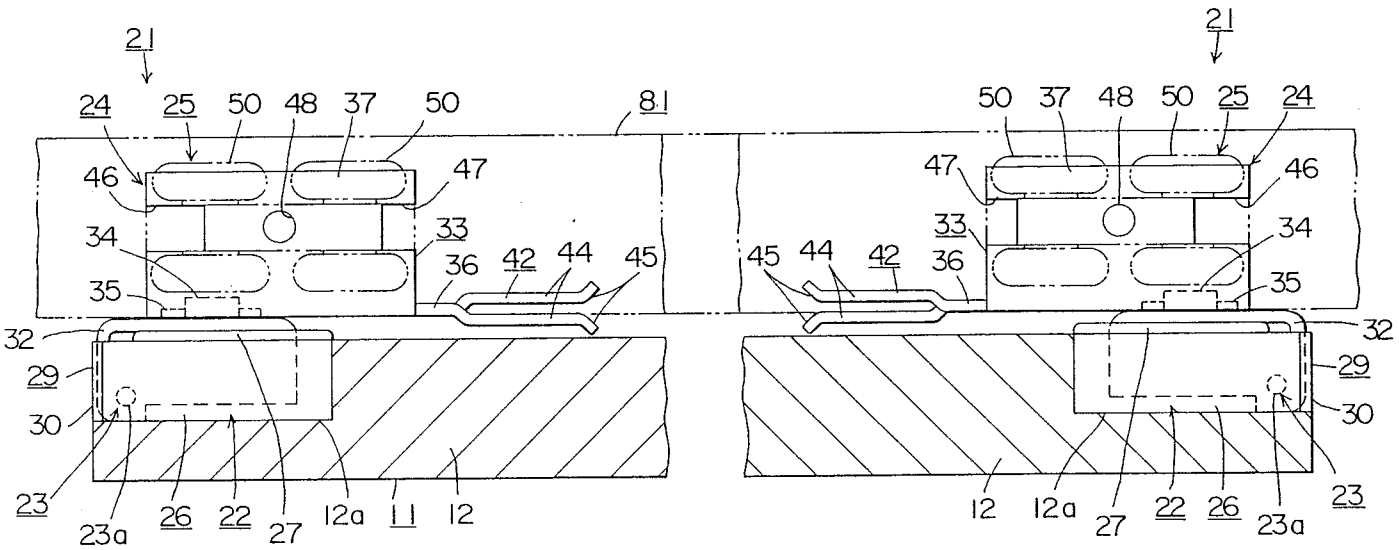
FIG. 4 is a partial plan view of the folding door in a closed condition.
Figure 5:
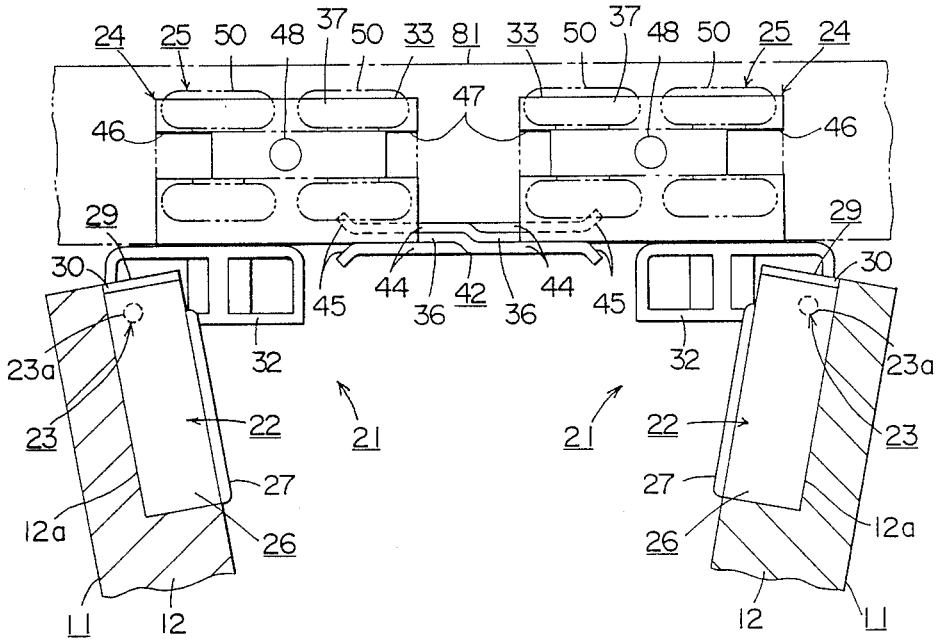
FIG. 5 is a partial plan view of the folding door in an open condition.

The vertical plate portion 36 is formed at its inner end with a connector portion 42 which has three horizontally extending grip pieces 44, vertically arranged with slits 43 formed therebetween. As shown in FIGS. 4 and 5, the top and bottom grip pieces 44 and the middle grip piece 44 are shifted alternately in the forward and rearward directions by an amount equal to the thickness of the plate. The grip pieces 44 each have a bent leading portion 45 at the front end to provide an expanded receptor opening. As shown in FIGS. 4 and 5, the left and right support plates 33 mounted on the pair of the door bodies 12 have their mating grip pieces 44 shifted in the opposite directions. That is, on the connector portion 42 of the left support plate 33, the top and bottom grip pieces 44 are deflected toward the front while the middle grip piece 44 is deflected toward the back. On the connector portion 42 of the right support plate 33, the top and bottom grip pieces 44 are deflected toward the back while the middle grip piece 44 is deflected toward the front. As a result, the grip pieces 44 of the connector portions 42 on the left and right support plates 33 can pass and engage each other.

The horizontal plate portion 37 is formed with notches 46, 47 at both ends and a hole 48 at the center.

The guide member 25 has a plurality of rollers 50 rotatably mounted on the front and back side of a plate-like holder 49. The holder 49 has downwardly extending connector projections 51 at both ends which engage with the notches 46, 47 of the horizontal plate portion 37. An adjustment bolt 52 is passed through the hole 48 of the horizontal plate portion 37 and screwed into the bottom of the holder 49. The adjust bolt 52 is used to adjust the vertical position of the support plate 33 with respect to the holder 49 and therefore the vertical position of the door body 12. The holder 49 has sliding projections 53 on the front and back side thereof that are formed on the upper part of the connector projections 51 so that they can engage the guide rail 81 described later. The lower end of each connector projection 51 is formed with a flange 51*a*.

A lower guide hinge body 61 is attached to the lower portion of and on the outer side of each door body 12 of the folding door 11. The guide hinge body 61 consists of a base 22 secured to the door body 12, a support member 62 supported rotatably on the base 22 through a hinge shaft 23*a*, and a guide member 63 supported movably by a guide rail 91 described later.

The base 22 is identical with the base 22 used on the upper guide hinge body 21.

The support member 62, as in the upper guide hinge body 21, consists of a support arm 32 and a support plate 64. The support plate 64 has a vertical plate portion 65 and a horizontal plate portion 66. The vertical plate portion 65 is formed with engagement holes and grooves in which a boss 34 and rib 35 of the support arm 32 engage. On the inner end, the vertical plate portion 65 has a connector portion 69 that is formed with three horizontally extending grip pieces 68, vertically arranged with slits 67 therebetween. The horizontal plate portion 66 has a pair of holes 70 spaced in a lateral direction. As with the connector portions 42, the connector portions 69 of the left and right support plates 64 attached to the paired door bodies 12 have the mating grip pieces 68 deflected in the opposite directions, forward and rearward, so that they can pass and engage each other.

The guide member 63 has a plurality of rollers 72 rotatably supported at the front and rear four corners of each of paired holders 71. A rod 73 connected to the upper side of the holder 71 passes through the hole 70 of the horizontal plate 66 and into a guide cylinder 74 in which the rod 73 is vertically movable. In the guide cylinder 74, a spring 76 is installed between the horizontal plate portion 66 and a ring 75 at the upper end of the rod 73 to urge the rollers 72 upwardly through the rod 73. The guide cylinders 74 are held inside a case 77, which is mounted by screws to the support plate 64.

The upper guide rail 81 is mounted to the front lower edge of the ceiling plate 2 of the furniture 1. The guide rail 81 is shaped almost like a letter U in cross section and has a rail groove 82 therein in which the rollers 50 rotatably engage. In the underside along the center, the guide rail 81 is formed with a guide groove 83 in which the holder 49 can be moved. On each side of the guide groove 83, roller receiver surfaces 84 are formed to support the bottom of each roller 50.

The lower guide rail 91 is laid in a groove 3*a* along the front edge of the bottom plate 3 of the furniture 1. The guide rail 91 is shaped almost like a letter U in cross section and has a rail groove 92 therein in which the rollers 72 of the lower guide hinge body 61 rotatably engage. The guide rail 91 also has a guide groove 93 formed in the upper side along the center in which the rod 73 can move. On each side of the guide groove 93, the guide rail 91 has roller receiver surfaces 94 to support the top of each roller 72.

Each door body 12 of the folding door 11 has a knob 95 at the central front.

The door body 12 of the folding door 11 mounted to the furniture 1 is suspended by the upper guide hinge bodies 21 whose rollers 50 are engaged with the upper guide rail 81. The door body 12 is also urged downwardly by the spring 76 of the lower guide hinge body 61 whose rollers 72 are engaged with the lower guide rail 91. The hinge shaft 23*a* of the upper guide hinge body 21 and the hinge shaft 23*a* of the lower guide hinge body 61 are vertically aligned on a single axis thus permitting the door body 12 to be horizontally opened and closed about the hinge shafts 23a.

With the folding door 11 closed, the door bodies 12 are supported on the hinges 13 in such a way that all the door bodies 12 are stretched flat in a plane completely closing the front of the storage space 6 of the furniture 1. The condition of the upper guide hinge body 21 is shown in FIG. 4. The same also applies to the lower guide hinge body 61.

To open the folding door 11, a person may hold the knob 95 of the door body 12 on the left and pull it forward and at the same time move the outer edge portion of that door body 12 toward the right door body 12. As a result, the rollers 50 of the upper guide hinge body 21 of the left door body 12 move along the upper guide rail 81 and the rollers 72 of the lower guide hinge body 61 move along the lower guide rail 91. Then, as shown in FIG. 5 (showing the upper guide hinge body 21), both of the left and right door bodies 12 rotate open about the hinge shafts 23*a* of the upper and lower guide hinges 21, 61 of the door bodies 12. The left and right door bodies 12 of the folding door 11 are folded at the central hinges 13 so that the back surfaces of the door bodies 12 come close together, and the folded door 11 is shifted to the right, leaving the front of the storage space 6 open on the left side of the folded door 11.

Since both of the left and right door bodies 12 can be moved by the guide hinge bodies 21, 61, it is possible to move the right-hand side door body 12 toward the left-hand side door body 12, folding them together and leaving the front of the storage space 6 open on the right side of the folded door 11. It is also possible to move the both door bodies 12 toward each other to fold them together, opening the front of the storage space 6 on each side of the folded door 11.

The folded door 11 can be moved laterally along the front of the storage space 6. By folding all the doors 11 and moving them to one side of the storage space 6, the front of the storage space 6 can be opened wide.

When both of the door bodies 12 of the folding door 11 are folded to the extreme open condition, as shown in FIGS. 5 and 6 (showing the upper guide hinge bodies 21), the upper guide hinge bodies 21 as well as the lower guide hinge bodies 61 on the pair of door bodies 12 come close to each other until the connector portions 42, 69 of the guide hinge bodies 21, 61 are coupled together. This process is explained in detail by taking the upper guide hinge bodies 21 for example. As shown in FIGS. 5 and 6, the grip pieces 44 of the paired connector portions 42 move past the mating grip pieces 44, staggered in the forward and backward directions, until they engage the both sides of the vertical plate portion 36 of the other guide hinge body 21, the grip portions 44 being so staggered alternately in the forward and backward directions that the top grip piece 44 engage one side of the vertical plate portion 36 followed by the second grip piece engaging the other side and the bottom grip piece engaging the first side. In this way, the outer end sides of the paired door bodies 12 are connected together.

As shown above, the paired guide hinge bodies 21, 61 of the paired door bodies 12 are coupled together. So, when the folding door 11 in the open condition, i.e., with the pair of the door bodies 12 folded, is moved along the guide rails 81, 91 by a person pushing the front end portion and applying a force F to that portion, the guide members 25, 63 of the guide hinge bodies 21, 61 are kept from becoming inclined to the guide rails 81, 91, thus preventing the folded door 11 from intermittently stopping and moving in a swinging motion. Therefore, the folded door 11 can be smoothly moved along the guide rails.

When the folded door 11 with its connector portions 42, 69 coupled together are to be unfolded for door closure, one or both of the paired door bodies 12 is or are moved away from each other. This disconnects the connector portions 42, 69 turning the door bodies 12 into the closed condition.

The folding door 11 can be moved laterally to the left or right along the front of the storage space 6 with the paired door bodies 12 stretched flat.

Figure 8:
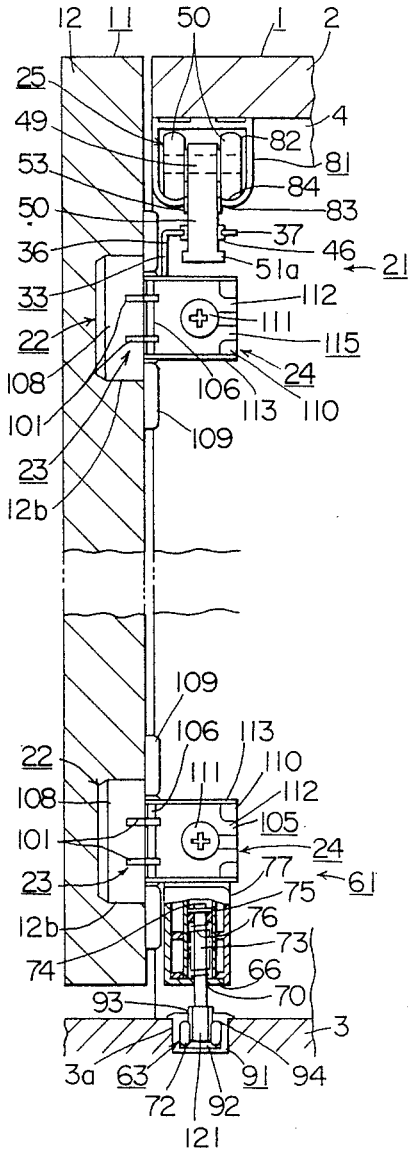
FIG. 8 is a partial cross-sectional view of the second embodiment as seen from one side.
Figure 7:
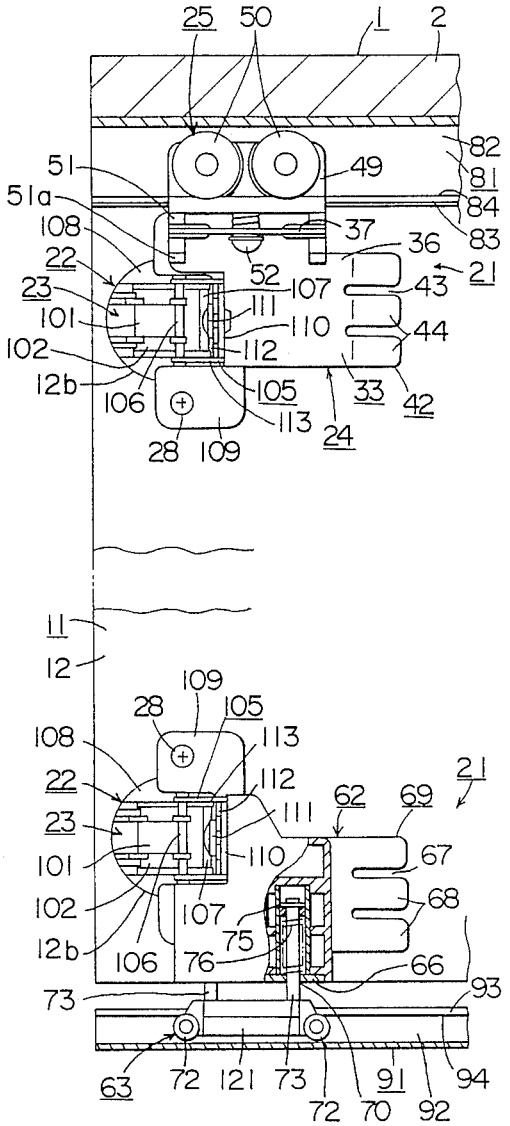
FIG. 7 is a partial cross-sectional view of the folding door apparatus as second embodiment of the invention, as seen from the back.
Figure 9:
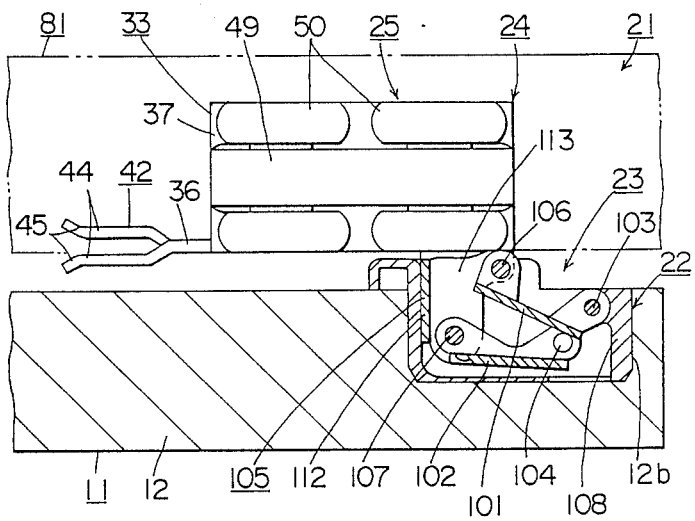
FIG. 9 is a partial plan view of the second embodiment.
Figure 10:
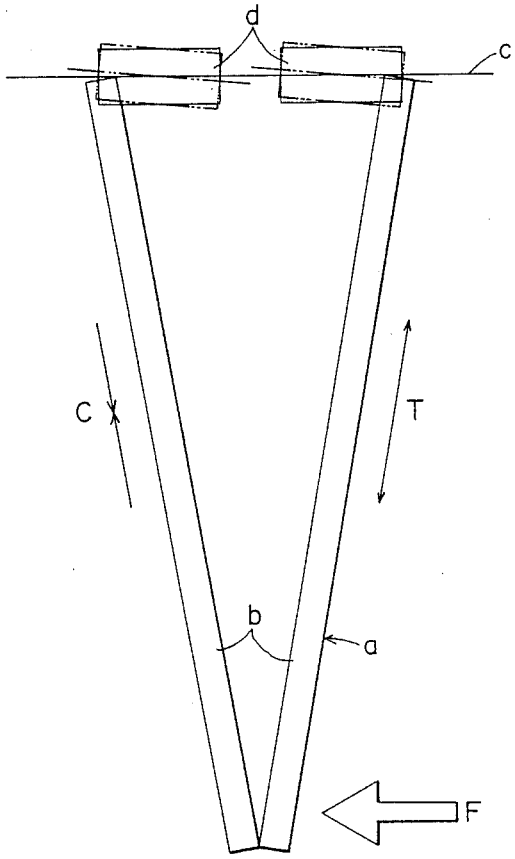
FIG. 10 PRIOR ART
FIG. 10 is a plan view showing the forces acting on a prior art folding door.

Next, we will explain a second embodiment of the invention by referring to FIGS. 7 through 9.

This embodiment differs from the first embodiment in the hinge mechanism 23 of the guide hinge bodies 21, 61. The hinge mechanism 23 of the second embodiment has a first link arm 101 and a second link arm 102. One end of each of these link arms 101, 102 is rotatably mounted, through a support shaft 103, 104, to the base 22 embedded in the door body 12. The other end of each of the link arms 101, 102 is rotatably mounted, through a support shaft 106, 107, to the arm mounting member 105 attached to the support member 24, 62.

The base 22 has a base cup 108 embedded in a recess 12*b*, which is formed in the back surface of the door body 12 at a position slightly shifted inwardly from the external end of the door body 12. The base cup 108 has a mounting pieces 109 projecting from the rear ends of the upper and lower portions thereof and which are mounted to the rear end surface of the door body 12 by set screws 28.

The arm mounting member 105 consists of: a mounting piece 112 fixed by a screw 111 to a mounting plate portion 110 bent at right angles from the support plate 33, 64 of the support member 24, 62; and a pair of arm support pieces 113 parallelly fixed to the upper and lower portions of the mounting piece 112 and engaged with the upper and lower surfaces of the mounting plate portion 110, the arm support pieces 113 having link arms 101, 102 both rotatably mounted on the support shafts 106, 107.

When the folding door 11 is opened or closed, the base 22 of the door body 12 is rotated open or closed through the link arms 101, 102 with respect to the support member 24, 62 that is moved along the guide rail 81, 91. As the door body 12 of the folding door 11 is rotated open, the two link arms 101, 102 are gradually moved forward causing the base 22 to rotate with the door body 12 and move forward. When the door body 12 of the folding door 11 is rotated closed, the two link arms 101, 102 are gradually retracted backward causing the base 22 to rotate with the door 12 and retract backward.

With the hinge mechanism 23 of the above construction, when the door body 12 is opened, the door body 12 is moved forward from the furniture 1 and the outer end portion of the door body 12 also moves forward away from the body of the furniture 1. This allows the base 22 to be embedded in the recess **12*b* at a position slightly shifted inwardly from the outer end of the door body 12. This construction prevents the base 22 of the closed door body 12 of other folding door 11 from being exposed to view when the adjacent folding door 11** is opened, thus improving the appearance of the door.

As shown in FIG. 7, the guide member 63 of the lower guide hinge body 61 is formed simpler and inexpensive. That is, the guide member 63 has one holder 121 for a pair of rods 73. The holder 121 is provided at each end with rotatably mounted rollers 72.

While in the above embodiment the connector portion is provided to both of the upper and lower guide hinge bodies, the connector portion need only be formed on at least one of them to ensure smooth movement of the folded door.

The construction of the connector portion of the guide hinge body is not limited to that shown in the above embodiments. Any other construction such as magnetic coupling may be employed as long as it allows coupling and decoupling of the paired hinge bodies.

In the foregoing embodiments, the folding door of the invention is shown applied to furniture in opening or closing the front of the storage space therein. The folding door is not limited to this use alone but may be used as an effective room compartment means. In this case, a plurality of folding doors can be used and they can be folded and moved to one side of the room.

With this invention, when the folding door is folded to the extreme open condition, the connector portions of the guide hinge bodies on two door bodies are coupled together connecting the two door bodies. Therefore, when the folding door in its open condition, i.e., with the paired door bodies folded together, is moved along the guide rails by a person pushing the front portion of the folded door, the guide members of the guide hinge bodies are prevented from inclining with respect to the guide rails, assuring smooth movement of the folded door along the guide rails.

What is claimed is:

1. An apparatus for smoothly moving a folding door along guide rails, wherein the folding door is made up by a pair of door bodies, each door body having internal and outer ends and upper and lower portions, rotatably connected at the internal ends so that the door bodies can be folded, comprising:

upper and lower guide rails for supporting and guiding the door bodies as the door bodies are folded together to open the door or unfolded flat to close the door, or for moving the door along the guide rails;

upper and lower guide hinge bodies, fitted to the upper and lower portions of the door bodies, respectively, each guide hinge body having a base secured to the outer end of each door body;

hinge mechanisms for each base of the upper and lower guide hinge bodies, support members mounted rotatably on each base through the hinge mechanism, respectively, a guide member provided on the support member and supported movably by the guide rail; and connector portions one each support member for removably connecting the support members when the door bodies are folded to an extreme open position so that the guide hinge bodies are kept in alignment with the guide rails when the folding door is moved along the guide rails.

2. An apparatus for smoothly moving a folding door along guide rails according to claim 1, wherein each said connector portion comprises three horizontally extending top, middle and bottom grip pieces, vertically arranged with slits formed therebetween, the top and bottom grip pieces and the middle grip piece being shifted alternately in forward and rearward directions, respectively, by an amount equal to the thickness of the piece.

* * * * *